US006717603B1

(12) United States Patent
Fisher

(10) Patent No.: US 6,717,603 B1
(45) Date of Patent: Apr. 6, 2004

(54) PREVENTING CREASE FORMATION IN DONOR WEB IN DYE TRANSFER PRINTER THAT CAN CAUSE LINE ARTIFACT ON PRINT

(75) Inventor: Terrence L. Fisher, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/242,263

(22) Filed: Sep. 12, 2002

(51) Int. Cl.[7] ..... B41T 17/30
(52) U.S. Cl. ..... 347/216; 400/248
(58) Field of Search ..... 400/234, 247, 400/248; 347/217, 216

(56) References Cited

U.S. PATENT DOCUMENTS 6,326,991 B1 * 12/2001 Kinjyo et al. ..... 347/216

FOREIGN PATENT DOCUMENTS

JP 01-110175 * 1/1989 ..... 400/248

* cited by examiner

*Primary Examiner*—Huan Tran
(74) *Attorney, Agent, or Firm*—Roger A. Fields

(57) ABSTRACT

A dye transfer printer uses a dye donor web that is capable of developing a crease-causing wave-like or ripple distortion across the donor web when the donor web is subjected to a longitudinal tension as it is advanced from a print head, over a web guide, and onto a web take-up spool in the printer. The web guide is positioned to extend across the donor web and is adapted to be bowed to effect a curvature across the donor web in proportion to the longitudinal web tension in order to urge the donor web to spread substantially widthwise to reduce the likelihood of the wave-like or ripple distortion developing across the donor web. If the wave-like or ripple distortion is prevented from developing in a dye transfer area being used, it is unlikely that any creases will be created in the next unused transfer area. Thus, no line artifacts will be printed on a dye receiver during dye transfer in the printer.

12 Claims, 12 Drawing Sheets

1

PREVENTING CREASE FORMATION IN DONOR WEB IN DYE TRANSFER PRINTER THAT CAN CAUSE LINE ARTIFACT ON PRINT

CROSS REFERENCE TO RELATED APPLICATIONS

Reference is made to commonly assigned applications Ser. No. 10/242,241 entitled PREVENTING CREASE FORMATION IN DONOR WEB IN DYE TRANSFER PRINTER THAT CAN CAUSE LINE ARTIFACT ON PRINT, filed Sep. 12, 2002 in the name of Terrence L. Fisher; Ser. No. 10/242,210 entitled PREVENTING CREASE FORMATION IN DONOR WEB IN DYE TRANSFER PRINTER THAT CAN CAUSE LINE ARTIFACT ON PRINT, filed Sep. 12, 2002 in the name of Terrence L. Fisher; Ser. No. 10/242,262 entitled PREVENTING CREASE FORMATION IN DONOR WEB IN DYE TRANSFER PRINTER THAT CAN CAUSE LINE ARTIFACT ON PRINT, filed Sep. 12, 2002 in the names of Terrence L. Fisher and Richard Salter; and Ser. No. 10/242,248 entitled PREVENTING CREASE FORMATION IN DONOR WEB IN DYE TRANSFER PRINTER THAT CAN CAUSE LINE ARTIFACT ON PRINT, filed Sep. 12, 2002 in the name of Terrence L. Fisher.

FIELD OF THE INVENTION

The invention relates generally to dye transfer printers such as thermal printers, and in particular to the problem of crease formation in the dye transfer area of a donor web used in the printer. Crease formation in the dye transfer area can result in an undesirable line artifact being printed on a dye receiver.

BACKGROUND OF THE INVENTION

A typical multi-color donor web that is used in a thermal printer is substantially thin and has a repeating series of three different color sections or patches such as a yellow color section, a magenta color section and a cyan color section. Also, there may be a transparent laminating section after the cyan color section.

Each color section of the donor web consists of a dye transfer area that is used for dye transfer printing and pair of longitudinal edge areas alongside the transfer area which are not used for printing. The dye transfer area is about 95% of the web width and the two edge areas are each about 2.5% of the web width.

To make a print, the various color dyes in the dye transfer areas of a single series of yellow, magenta and cyan color sections on a donor web are successively heat-transferred by a print head onto a dye receiver such as paper or transparency sheet or roll. The dye transfer from each transfer area to the dye receiver is done line-by-line widthwise across the transfer area via a bead of selectively heated resistive elements on the print head. The print head makes line contact across the entire width of the color section, but it only heats the dye transfer area, i.e. it does not heat the two edge areas alongside the dye transfer area.

As each color section is used for dye transfer at the print head, the donor web is subjected to a longitudinal tension between a donor supply spool and a donor take-up spool which are rearward and forward of the print head, and particularly at a fixed web guide between the print head and the donor take-up spool. The longitudinal tension, coupled with the heat from the print head, causes a used color section to be stretched lengthwise at least from the print head to the donor take-up spool. Since the dye transfer area in a used color section has been heated by the print head, but the two edge areas alongside the transfer area have not been heated, the transfer area tends to be stretched more than the edge areas. As a result, the transfer area becomes thinner than the two edge areas and develops a wave-like or ripple distortion widthwise between the edge areas.

After the last line is transferred from a dye transfer area to a dye receiver, and as the used color section is advanced forward from the print head and onto the donor take-up spool, the wave-like or ripple distortion in the transfer area causes one or more creases to form at least in a short trailing or rear end portion of the transfer area that has not been used for dye transfer. The creases tend to spread rearward from the trailing or rear end portion of the used transfer area into a leading or front end portion of an unused transfer area in the next (fresh) color section being advanced to the print head. The creases appear to be created because of the difference in thickness between the used transfer area and the edge areas as they are wound under tension from the print head and onto the donor take-up spool.

A problem that can result is that a crease in the leading or front end portion of the unused transfer area of the next (fresh) color section will cause an undesirable line artifact to be printed on a leading or front end portion of the dye receiver when the print head is applied to the crease. The line artifact printed on the receiver is about 0.5 inches in length.

The question presented therefore is how to solve the problem of the creases being created in the unused transfer area of each fresh color section so that no line artifacts are printed on the dye receiver.

SUMMARY OF THE INVENTION

A dye transfer printer in which a dye donor web is capable of developing a crease-causing wave-like or ripple distortion across the donor web when the donor web is subjected to a longitudinal tension as it is advanced from a print head, over a web guide, and onto a web take-up spool, is characterized in that:

the web guide is positioned to extend across the donor web and is adapted to be bowed to effect a curvature across the donor web in proportion to the longitudinal web tension in order to urge the donor web to spread substantially widthwise to reduce the likelihood of the wave-like or ripple distortion developing across the donor web.

If the wave-like or ripple distortion is prevented from developing across the donor web, it is unlikely that any of the creases will be created in the unused transfer area of each fresh color section. Thus, no line artifacts can be printed on the dye receiver.

DETAILED DESCRIPTION OF THE INVENTION

Donor Web

Figure 1:
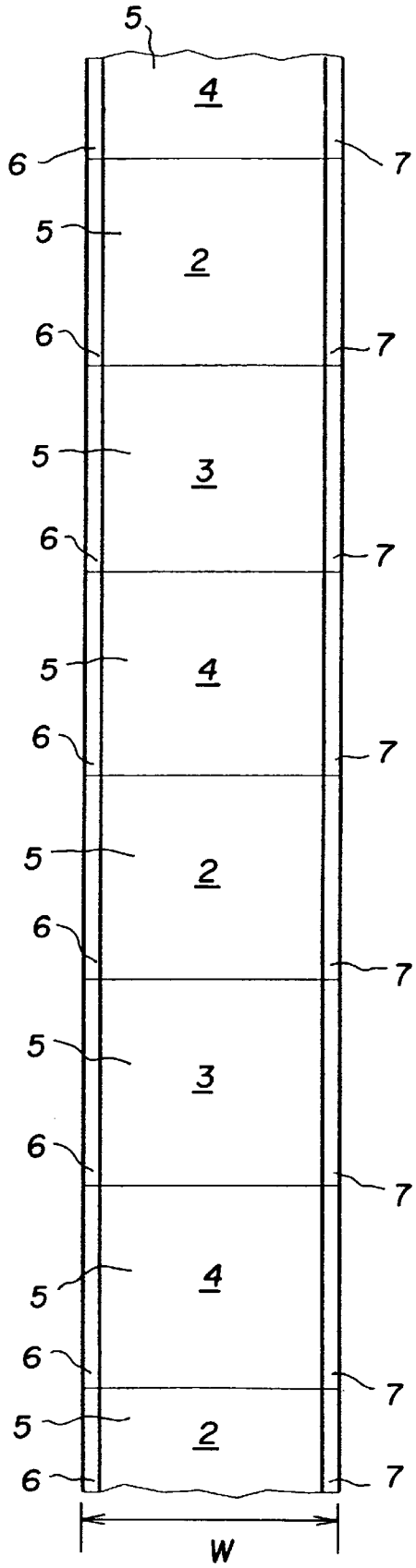
FIG. 1 is plan view of a donor web including successive dye transfer areas and opposite edge areas alongside each one of the dye transfer areas.

FIG. 1 depicts a typical multi-color donor web or ribbon 1 that is used in a thermal color-printer. The donor web 1 is substantially thin and has a repeating series (only two shown) of three different color sections or patches such as a yellow color section 2, a magenta color section 3 and a cyan color section 4. Also, there may be a transparent laminating section (not shown) after the cyan color section 4.

Each one of the successive color sections 2–4 of the donor web 1 consists of a dye transfer area 5 that is used for dye transfer printing and pair of longitudinal edge areas 6 and 7 alongside the transfer area which are not used for printing. The dye transfer area 5 is about 95% of the web width W and the two edge areas 6 and 7 are each about 2.5% of the web width.

Dye Transfer Printer

FIGS. 2–6 depict operation of a known prior art thermal color-printer 10.

Figure 2:
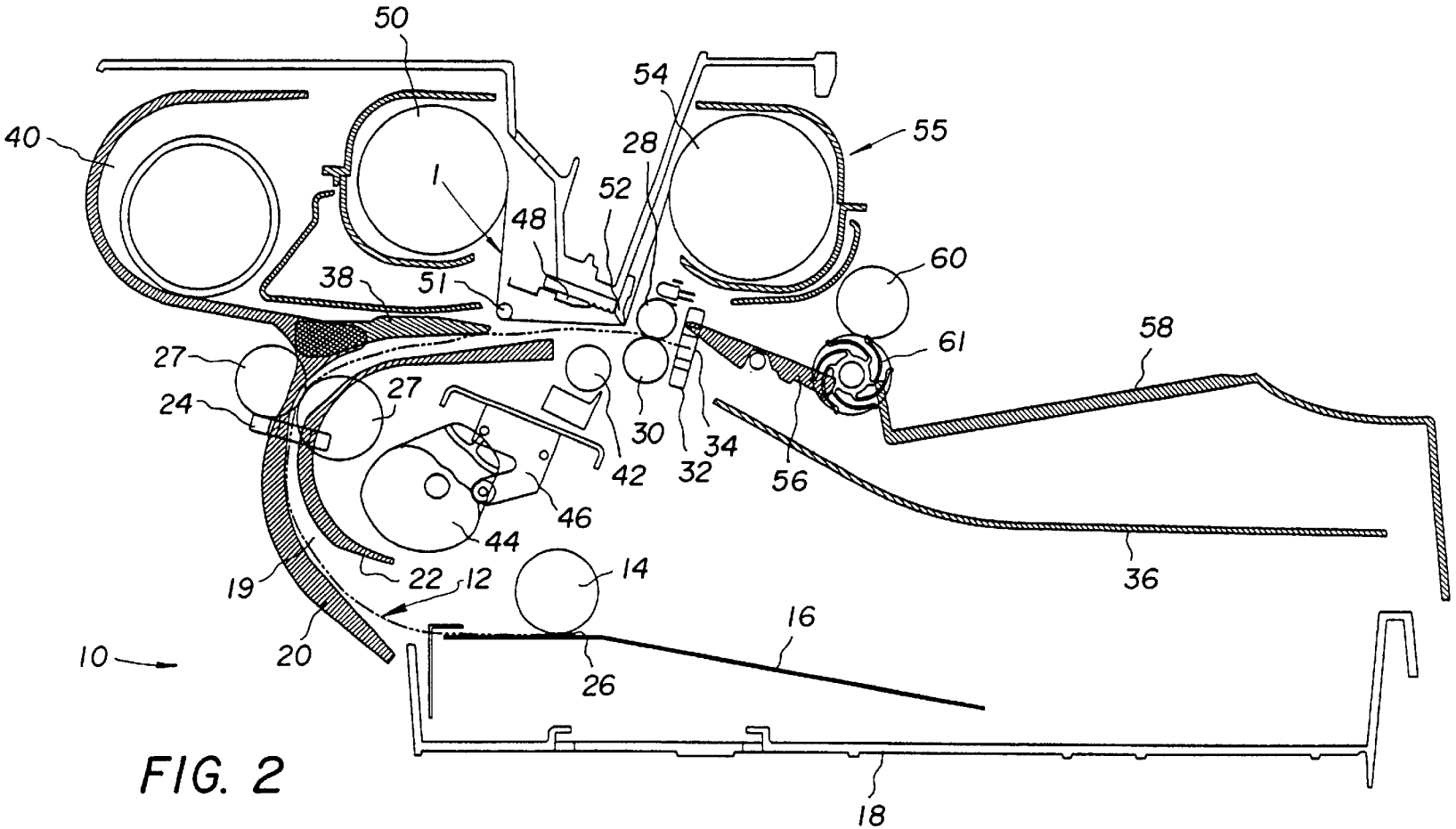
FIG. 2 is an elevation section view, partly in section, of a dye transfer printer, showing a beginning cycle during a printer operation.

Beginning with FIG. 2, a dye receiver sheet 12, e.g. paper or transparency, is initially advanced forward via coaxial pick rollers 14 (only one shown) off a floating platen 16 in a tray 18 and into a channel 19 defined by a pair of curved longitudinal guides 20 and 22. When a trailing (rear) edge sensor 24 midway in the channel 19 senses a trailing or rear edge 26 of the receiver sheet 12, it activates at least one of pair of parallel axis urge rollers 27, 27 in the channel 19. The activated rollers 27, 27 advance the receiver sheet 12 forward through the nip of a capstan roller 28 and a pinch roller 30, positioned beyond the channel 19, and to a leading (front) edge sensor 32.

Figure 3:
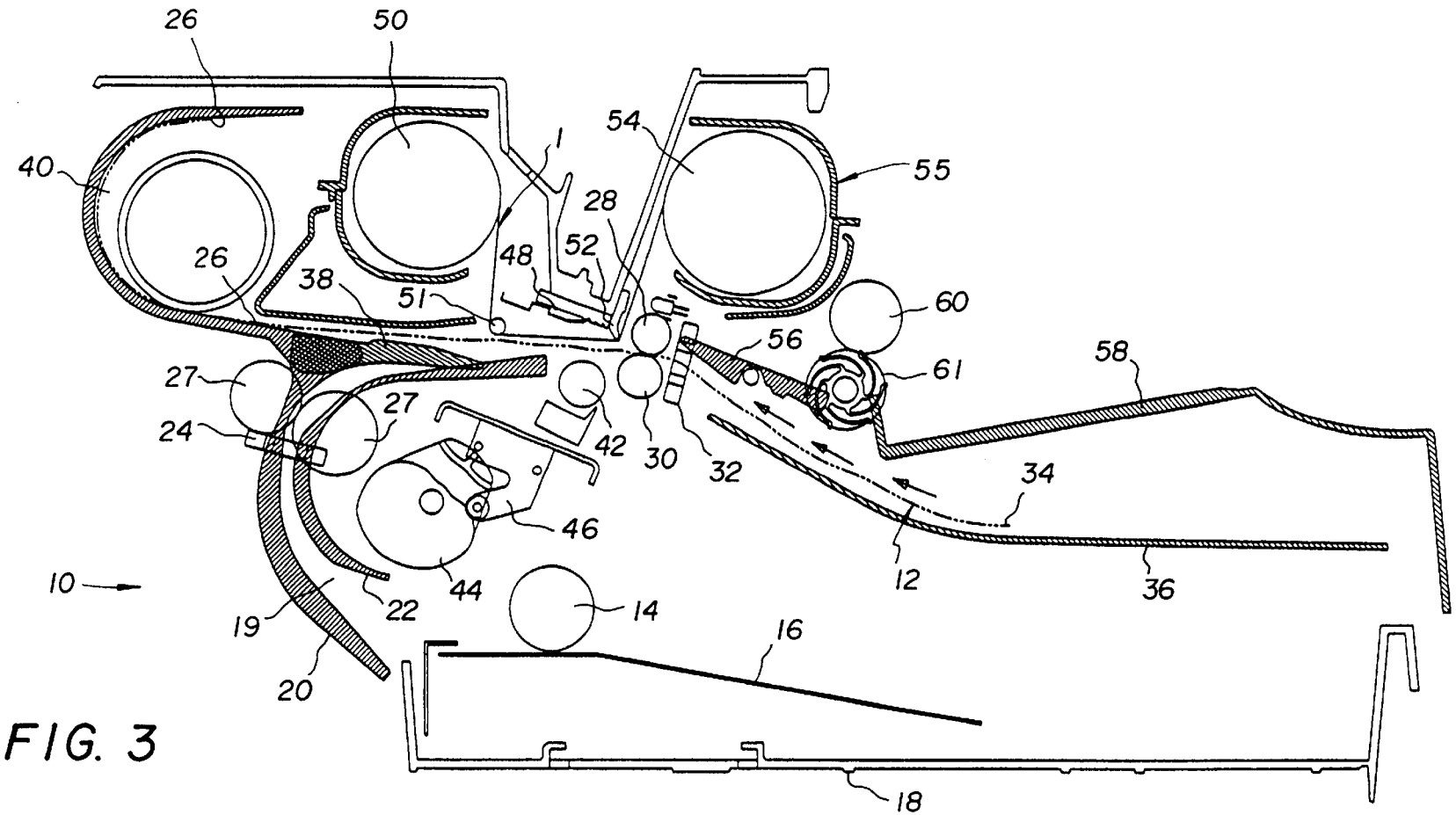
FIGS. 3 and 4 are elevation section views of the dye transfer printer as in FIG. 2, showing other cycles during the printer operation.

In FIG. 3, the leading edge sensor 32 has sensed a leading or front edge 34 of the dye receiver sheet 12 and activated the capstan roller 28 to cause that roller and the pinch roller 30 to advance the receiver sheet forward onto an intermediate tray 36. The receiver sheet 12 is advanced forward into the intermediate tray 36 so that the trailing or rear edge 26 of the receiver sheet can be moved beyond a hinged exit door 38 which is a longitudinal extension of the curved guide 20. Then, as illustrated, the hinged exit door 38 closes and the capstan and pinch rollers 28 and 30 are reversed to advance the receiver sheet 12 rearward, i.e. rear edge 26 first, partially into a rewind chamber 40.

To make a print, the various color dyes in the dye transfer areas 5 of a single series of the color sections 2, 3 and 4 on the donor web 1 must be successively heat-transferred onto the dye receiver sheet 12. This is shown in FIGS. 4 and 5.

Figure 4:
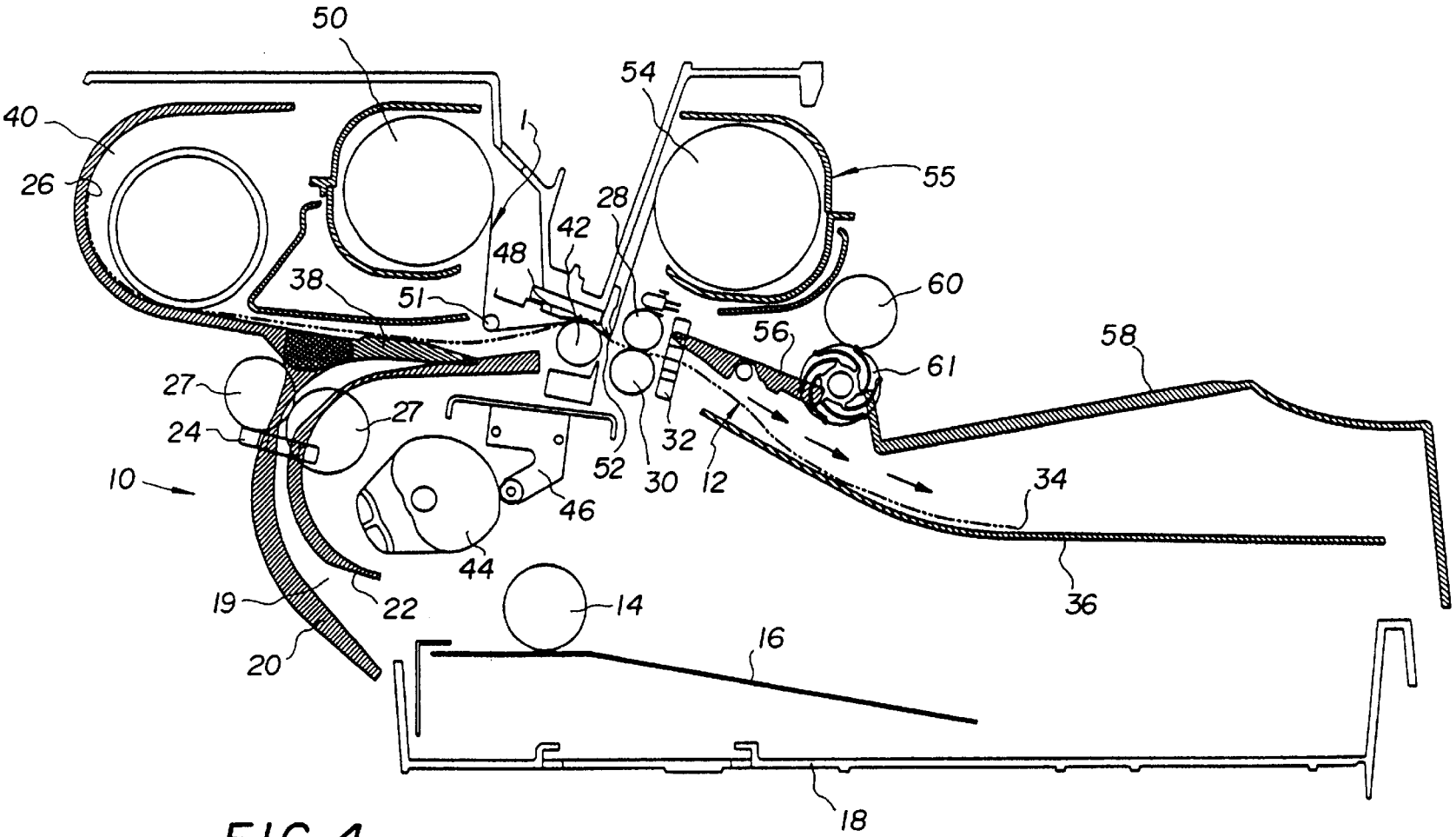

In FIG. 4, a platen roller 42 is shifted via a rotated cam 44 and a platen lift 46 to adjacent a thermal print head 48. This causes the dye receiver sheet 12 and a first one of the successive color sections 2, 3, and 4 of the donor web 1 to be locally held together between the platen roller 42 and the print head 48. The capstan and pinch rollers 28 and 30 are reversed to again advance the dye receiver sheet 12 forward to begin to return the receiver sheet to the intermediate tray 36. At the same time, the donor web 1 is advanced forward under a longitudinal tension, from a donor supply spool 50, over a first fixed web guide 51, the print head 48 and a second fixed web guide 52, and then onto a donor take-up spool 54. The donor supply and take-up spools 50 and 54 together with the donor web 1 are provided in a replaceable cartridge 55 that is loaded into the printer 10.

When the first one of the successive color sections 2, 3 and 4 of the donor web 1 is moved forward in intimate contact with the print head 48 in FIG. 4, the color dye in the dye transfer area 5 of that color section is heat-transferred onto the dye receiver sheet 12. The dye transfer from the transfer area 5 to the receiver sheet 12 is done line-by-line widthwise across the transfer area via a bead of selectively heated resistive elements (not shown) on the print head 48. The print head 48 makes line contact across the entire width W of the first color section 2 as depicted in FIG. 5 (the second fixed web guide 52 and the dye receiver sheet 12 are not shown). However, the print head 48 only heats the dye transfer area 5, i.e. it does not heat two edge areas 6 and 7 alongside the transfer area.

Figure 5:
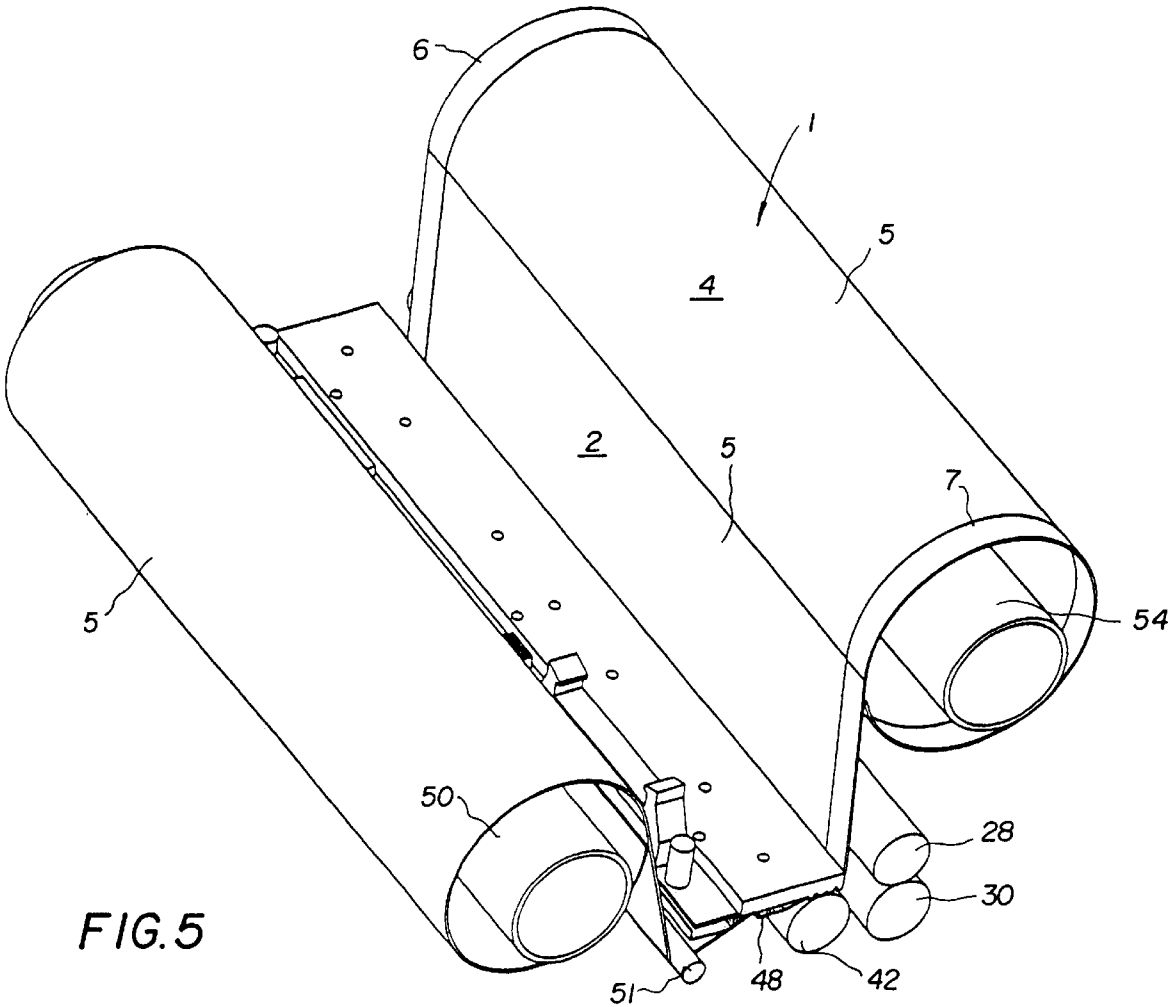
FIG. 5 is perspective view of a printing or dye transfer station in the dye transfer printer.

As the first color section 2 is used for dye transfer line-by-line, it moves from the print head 48 and over the second fixed web guide 52 in FIGS. 4 and 5. Then, once the dye transfer for the first color section 2 is completed, the platen roller 42 is shifted via the rotated cam 44 and the platen lift 46 from adjacent the print head 48 to separate the platen roller from the print head. This is shown in FIG. 3.

Then, the capstan and pinch rollers 28 and 30 are reversed to advance the dye receiver sheet 12 rearward, i.e. trailing or rear edge 26 first, partially into the rewind chamber 40 and the used color section 2 is wrapped about the donor take-up spool 54. See FIG. 3.

Then, the cycle in FIG. 4 is repeated with the next (fresh) one of the successive color sections 2, 3 and 4.

Once the last one of the successive color sections 2, 3 and 4 is used, the dye transfer to the dye receiver sheet 12 is completed. Then, in FIG. 3, the platen roller 42 is shifted via the rotated cam 44 and the platen lift 46 from adjacent the print head 48 to separate the platen roller from the print head, the capstan and pinch rollers 28 and 30 are reversed to advance the receiver sheet 12 rearward, i.e. trailing or rear edge 26 first, partially into the rewind chamber 40, and the last color section 4 is wrapped about the donor take-up spool 54.

Figure 6:
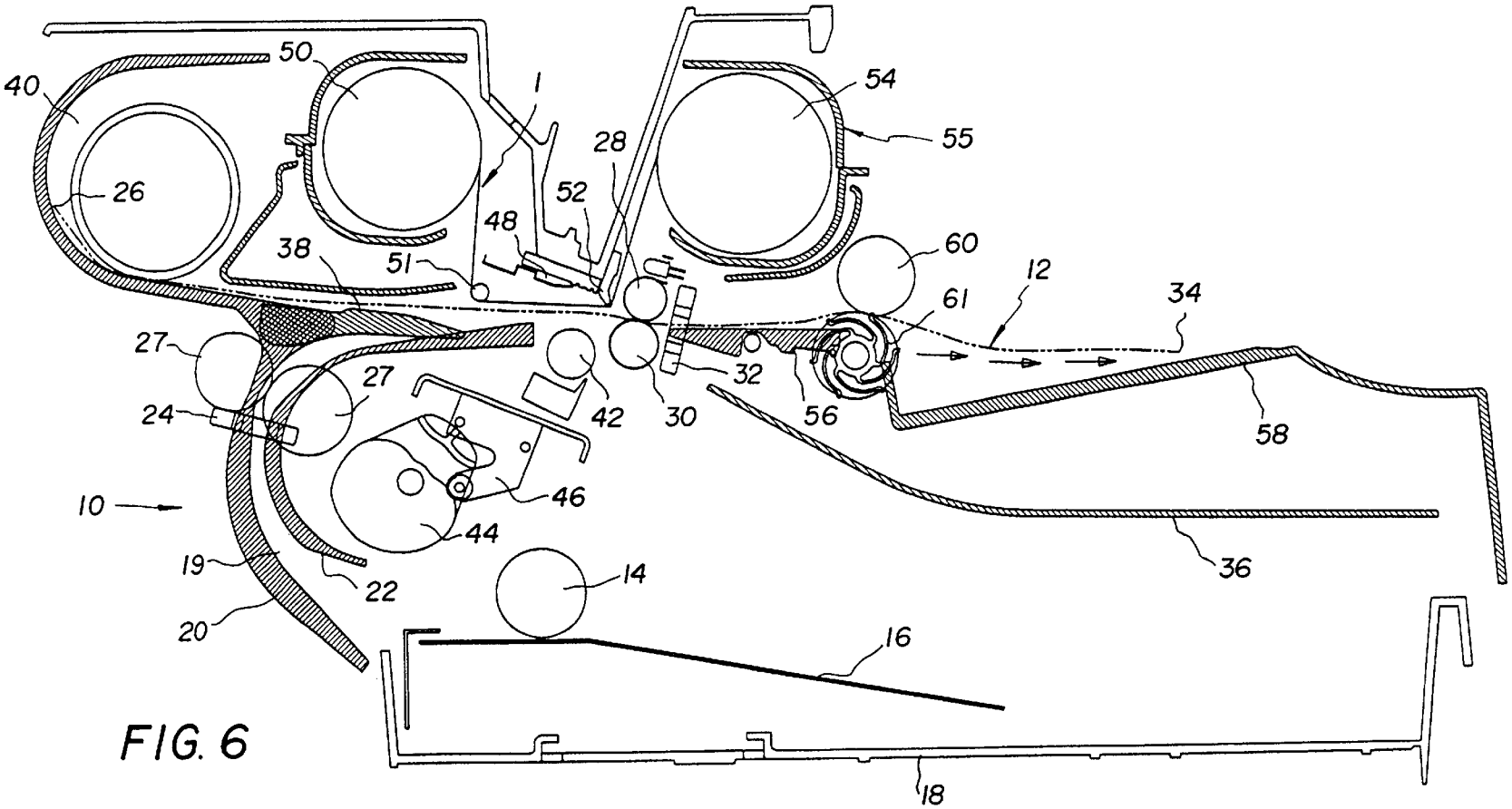
FIG. 6 is an elevation section view of the dye transfer printer as in FIG. 2, showing a final cycle during the printer operation.

Finally, as shown in FIG. 6, the platen roller 42 remains separated from the print head 48 and the capstan and pinch rollers 28 and 30 are reversed to again advance the dye receiver sheet 12 forward. However, in this instance a diverter 56 is pivoted to divert the receiver sheet 12 to an exit tray 58 instead of returning the receiver sheet to the intermediate tray 36 as in FIG. 4. A pair of parallel axis exit rollers 60 and 62 aid in advancing the receiver sheet 12 into the exit tray 58.

Prior Art Problem

Figure 7:
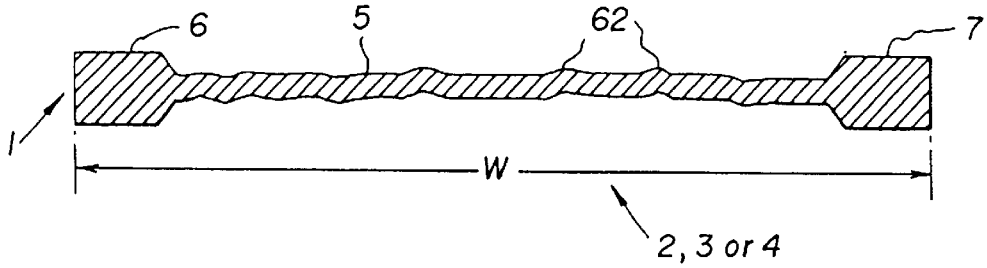
FIG. 7 is a cross section view of the donor web when the dye transfer area has been stretched thinner than the two edge areas alongside the dye transfer area, showing a wave-like or ripple distortion widthwise between the edge areas.

As each one in a single series of the color sections 2, 3 and 4 of the donor web 1 is successively used for dye transfer at the print head 48 in FIGS. 4 and 5, it is stretched lengthwise under tension, particularly over the second fixed web guide 52. Since the dye transfer area 5 in a used color section 2, 3 or 4 has been heated by the print head 48, but the two edge areas 6 and 7 alongside the transfer area have not been heated, the transfer area tends to be stretched under tension more than the edge areas. As a result, the dye transfer area 5 becomes thinner than the two edge areas and develops a wave-like or ripple distortion 62 widthwise between the edge areas. This is shown in FIG. 7.

After the last line is transferred from a dye transfer area 5 to the dye receiver sheet 12, and as the used color section 2, 3 or 4 is advanced forward from the print head 48, over the second fixed web guide 52, and onto the donor take-up spool 54, the wave-like or ripple distortion 62 in the transfer area causes one or more creases 64 to be formed at least in a short trailing or rear end portion 66 of the transfer area that has not been used for dye transfer. See FIG. 8. The creases 64 tend to spread rearward from the trailing or rear end portion 66 of the used transfer area 5 into a leading or front end portion 68 of an unused transfer area 5 in the next (fresh) color section 2, 3 or 4 being advanced to the print head 48. The creases 64 appear to be created because of the difference in thickness between the used transfer area 5 and the edge areas 6 and 7 as they are wound under tension from the print head 48, over the second web guide 42, and onto the donor take-up spool 54.

Figure 9:
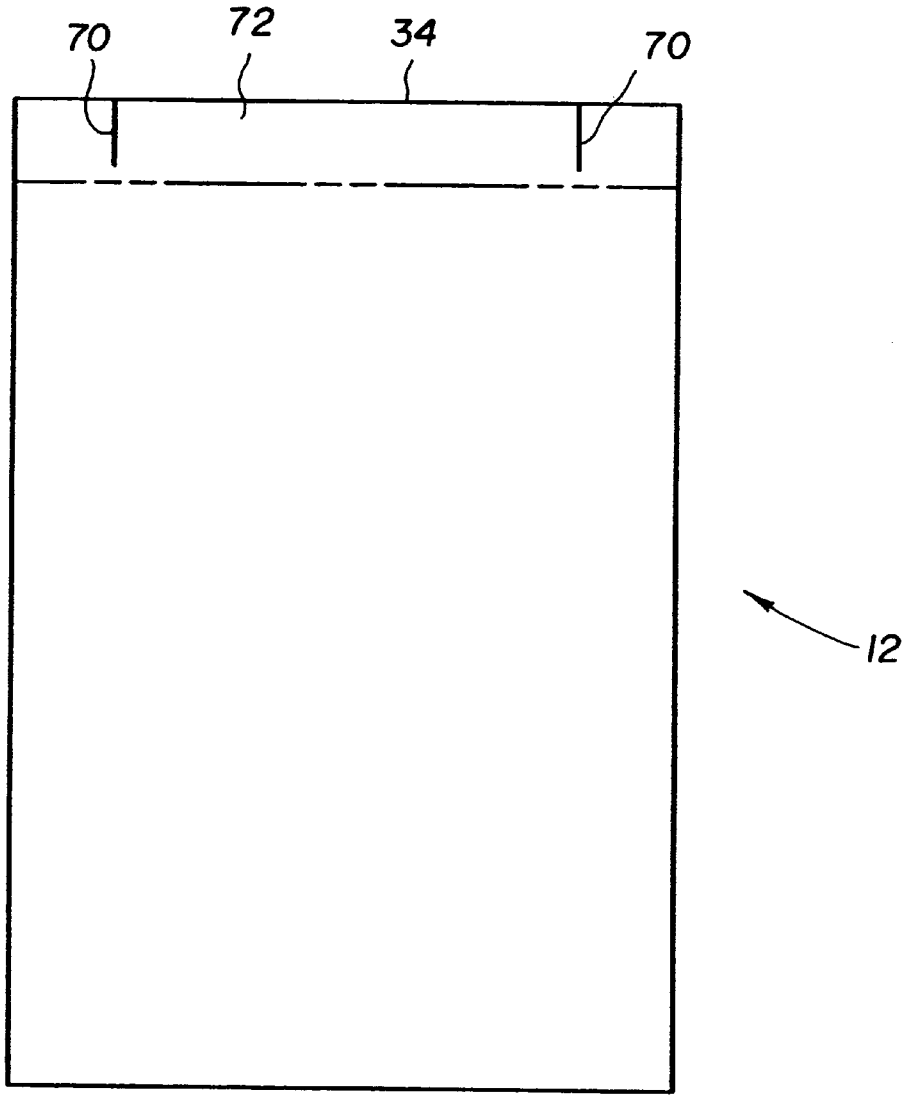
FIG. 9 is a plan view of a dye receiver sheet, showing line artifacts printed on a leading or front edge portion of the receiver sheet.

A problem that can result is that a crease 64 in the leading or front end portion 68 of the unused transfer area 5 of the next (fresh) color section 2, 3 or 4 will cause an undesirable line artifact 70 to be printed on a leading or front end portion 72 of the dye receiver sheet 12 when the print head 48 is applied to the crease. See FIG. 9. The line artifact 70 printed on the dye receiver sheet 12 is about 0.5 inches in length.

The question presented therefore is how to solve the problem of the creases 64 being created in the unused transfer area 5 of each fresh color section 2, 3 or 4 so that no line artifacts 70 are printed on the dye receiver sheet 12.

Solution

Figure 8:
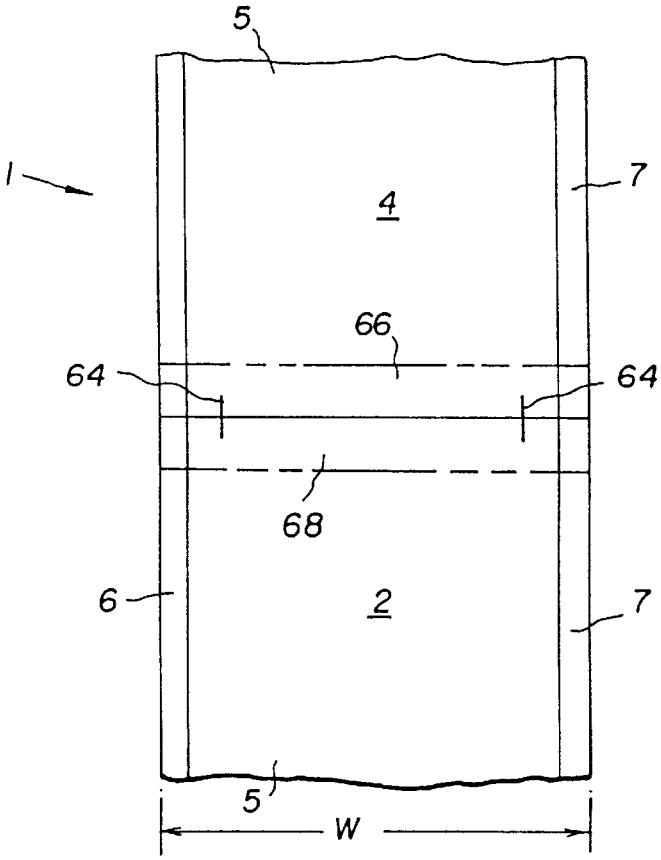
FIG. 8 is a plan view of the donor web, showing creases spreading rearward from a trailing or rear end portion of a used transfer area into a leading or front end portion of an unused transfer area in the next (fresh) color section.

It has been determined that the likelihood of the wave-like or ripple distortion 62 developing across the donor web 1 in the dye transfer printer 10 (as shown in FIG. 7) when the donor web 1 is advanced under tension from the donor supply spool 50, over the first fixed web guide 51. the print head 48 and the second fixed web guide 52, and onto the donor take-up spool 54 can be significantly reduced. This is done by effecting a curvature across the donor web 1 in proportion to the longitudinal web tension in order to urge the donor web to spread substantially widthwise. If the wave-like or ripple distortion 62 is prevented from developing across the donor web 1, it is unlikely that any of the creases 64 will be formed in the short trailing or rear end portion 66 of the transfer area 5 that has not been used for dye transfer as shown in FIG. 8.

Figure 10:
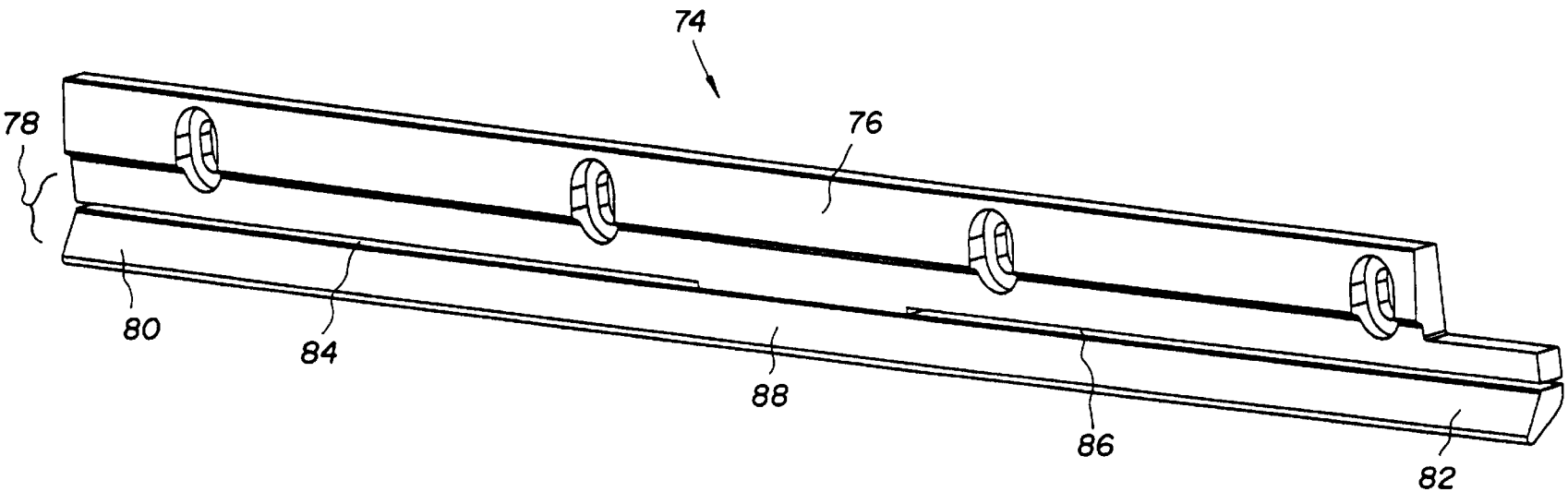
FIG. 10 is perspective view of an improved web guide according to a preferred embodiment of the invention.
Figure 11:
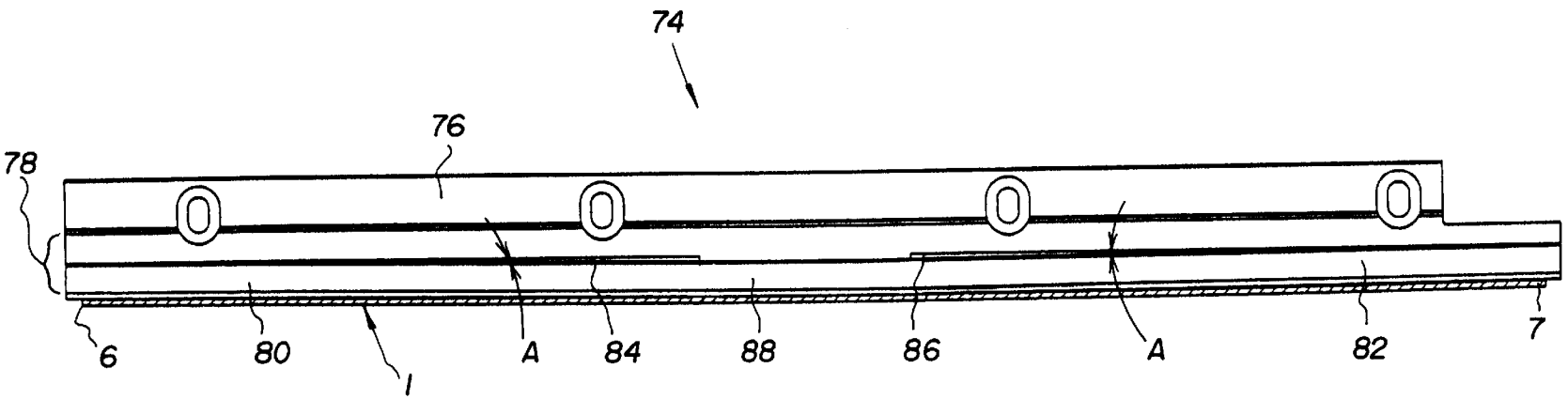
FIG. 11 is an elevation view of the improved web guide.

FIGS. 10 and 11 depict a non-fixed web guide 74 that is an improvement over the second fixed web guide 52 in the printer 10. The improved web guide 74 is intended to replace the second fixed web guide 52 in the printer 10.

The improved web guide 74 comprises a longitudinal bracket 76 and a longitudinal guide bar 78 which are a single piece of extruded aluminum, stainless steel, plastic or other suitable known material.

The guide bar 78 is positioned to extend across the entire width W of the donor web 1 and is adapted to be slightly bowed to effect a slight curvature across the donor web, as shown in FIG. 1, in proportion to the longitudinal web tension, in order to urge the donor web to spread substantially widthwise (toward its edge areas 6 and 7) to reduce the likelihood of the wave-like or ripple distortion 62 developing across the donor web. Specifically, the guide bar 78 has a pair of opposite longitudinal compliant, resilient, flexible wings 80 and 82 for supporting the donor web 1 substantially widthwise and respective narrow slots 84 and 86 alongside the wings that permit the wings to be independently bent lengthwise into the slots by the longitudinal web tension to effect the curvature across the donor web. The slots 84 and 86 are longitudinally coextensive with the wings 80 and 82 and are narrow enough (e.g. 0.3–0.4 inches) to limit the wings to being bent to an acute angle A of about 0.4° in FIG. 1.

The guide bar 78 has a compliant, resilient, elastic middle portion 88 between the wings 80 and 82 for supporting the donor web 1 substantially widthwise with the wings. The middle portion 88 is substantially shorter than the wings 80 and 82 and cannot be bent by the longitudinal web tension when the wings are bent into the slots 84 and 86 because the slots do not extend alongside the middle portion.

Optionally, in addition to the improved web guide 74, a non-fixed web guide 90 can be used to replace the first fixed web guide 51 in the printer 10.

Figure 12:
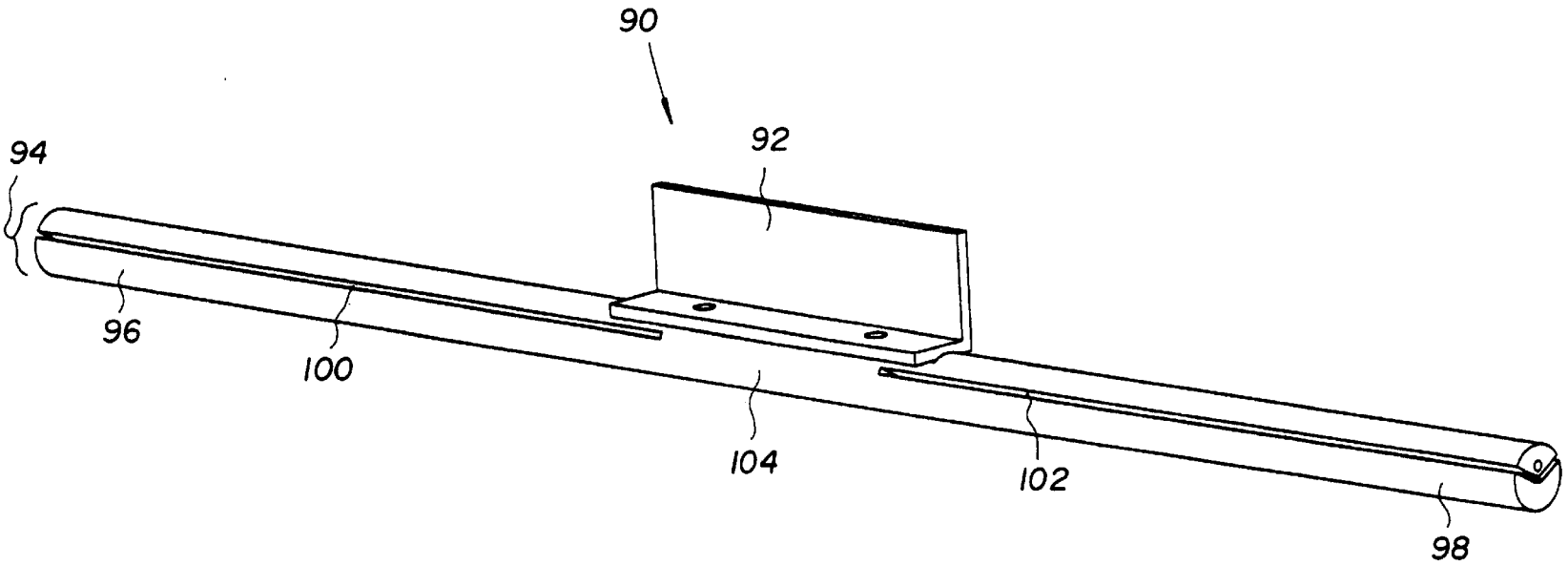
FIG. 12 is perspective view of an alternate version of the improved web guide.

The improved web guide 90 comprises a longitudinal bracket 92 and a longitudinal guide bar 94 which are a single piece of extruded aluminum, stainless steel, plastic or other suitable known material. See FIGS. 12 and 13.

Figure 13:
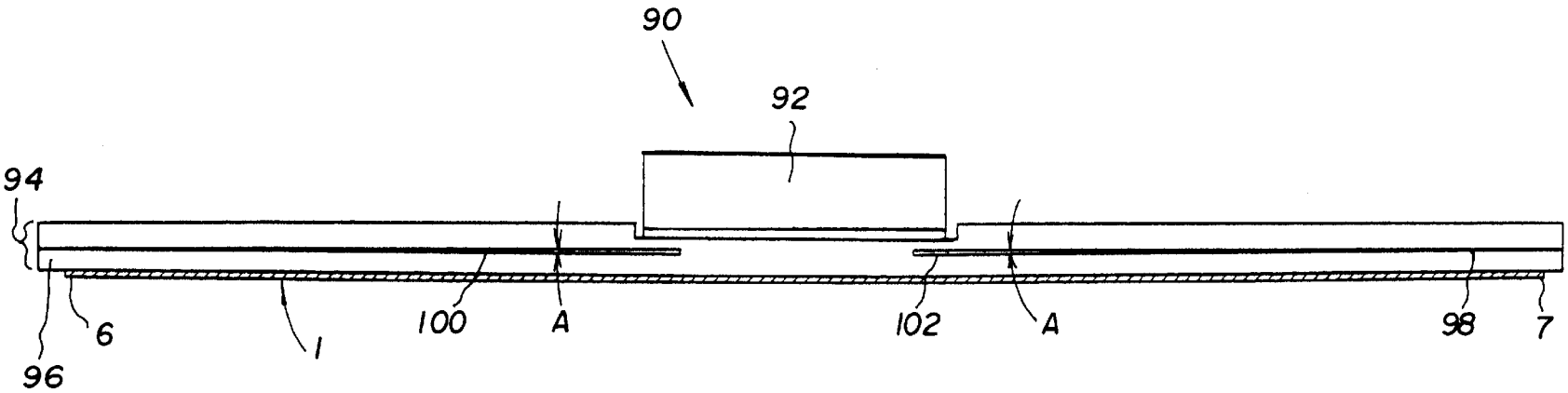
FIG. 13 is an elevation view of the alternate version of the improved web guide.

The guide bar 94 is positioned to extend across the entire width W of the donor web 1 and is adapted to be slightly bowed to effect a slight curvature across the donor web, as shown in FIG. 13, in proportion to the longitudinal web tension, in order to urge the donor web to spread substantially widthwise (toward its edge areas 6 and 7) to reduce the likelihood of the wave-like or ripple distortion 62 developing across the donor web. Specifically, the guide bar 94 has a pair of opposite longitudinal compliant, resilient, flexible wings 96 and 98 for supporting the donor web 1 substantially widthwise and respective narrow slots 100 and 102 alongside the wings that permit the wings to be independently bent lengthwise into the slots by the longitudinal web tension to effect the curvature across the donor web. The slots 100 and 102 are longitudinally coextensive with the wings 96 and 98 and are narrow enough (e.g. 0.3–0.4 inches) to limit the wings to being bent to an acute angle A of about 0.4° in FIG. 13.

The guide bar 94 has a compliant, resilient, elastic middle portion 104 between the wings 96 and 98 for supporting the donor web 1 substantially widthwise with the wings. The middle portion 104 is substantially shorter than the wings 96 and 98 and cannot be bent by the longitudinal web tension when the wings are bent into the slots 100 and 102 because the slots do not extend alongside the middle portion.

The invention has been described in detail with particular reference to certain preferred embodiments thereof, but it will be understood that variations and modifications can be effected within the spirit and scope of the invention. For example, rotatable set screws (not shown) can be provided which extend into the slots 84 and 86 in FIG. 11 and the slots 100 and 102 in FIGS. 12 and 13 to vary the acute angle A.

PARTS LIST

1. donor web
2. cyan color section

3. magenta color section
4. yellow color section
5. dye transfer area
6. longitudinal edge area
7. longitudinal edge area
W. web width
10. thermal printer
12. dye receiver sheet
14. pick rollers
16. platen
18. tray
19. channel
20. longitudinal guide
22. longitudinal guide
24. trailing edge sensor
26. trailing edge
27. urge rollers
28. capstan roller
30. pinch roller
32. leading edge sensor
34. leading or front edge
36. intermediate tray
38. exit door
40. rewind chamber
42. platen roller
44. cam
46. platen lift
48. print head
50. donor supply spool
51. first fixed Web guide
52. second fixed web guide
54. donor take-up spool
55. cartridge
56. diverter
58. exit tray
60. exit roller
61. exit roller
62. wave-like or ripple distortion
64. creases
66. trailing or rear end portion
68. leading or front end portion
70. line artifacts
72. leading or front end portion
74. improved non-fixed web guide
76. bracket
78. guide bar
80. wing
82. wing
84. slot
86. slot
A. acute angle
88. middle portion
90. improved non-fixed web guide
92. bracket
94. guide bar
96. wing
98. wing
100. slot
102. slot
104. middle portion

What is claimed is:

1. A dye transfer printer in which a dye donor web is capable of developing a crease-causing wave-like or ripple distortion across the donor web when the donor web is subjected to a longitudinal tension as it is advanced from a print head, over a web guide, and onto a web take-up spool, is characterized in that:

said web guide is positioned to extend across the donor web and is adapted to be bowed to effect a curvature across the donor web in proportion to the longitudinal web tension in order to urge the donor web to spread substantially widthwise to reduce the likelihood of the wave-like or ripple distortion developing across the donor web, and said web guide includes a longitudinal guide bar for supporting the donor web substantially widthwise and that is compliant to become bowed lengthwise by the longitudinal web tension to effect said curvature across the donor web.

2. A dye transfer printer as recited in claim 1, wherein said guide bar has a pair of opposite longitudinal wings that can be independently bent for said guide bar to become bowed.

3. A dye transfer printer as recited in claim 2, wherein said wings are limited to being bent to an acute angle.

4. A dye transfer printer as recited in claim 2, wherein said acute angle is about 0.4°.

5. A dye transfer printer as recited in claim 2, wherein said guide bar has a middle portion between said wings that is substantially shorter than said wings and cannot be bent when said wings are bent.

6. A dye transfer printer as recited in claim 5, wherein said web guide includes respective longitudinal spaces alongside said wings to permit said wings to be independently bent into said spaces and no similar space alongside said middle portion between said wings to prevent said middle portion from being bent.

7. A dye transfer printer as recited in claim 1, wherein said web guide includes a longitudinal guide bar having a pair of opposite longitudinal compliant wings for supporting the donor web substantially widthwise and respective slots alongside said wings that permit said wings to be similarly bent lengthwise into said slots by the longitudinal web tension to effect said curvature across the donor web.

8. A dye transfer printer as recited in claim 7, wherein said slots are longitudinally coextensive with said wings.

9. A dye transfer printer as recited in claim 7, wherein said guide bar has a middle portion between said wings for supporting the donor web substantially widthwise with said wings and that is substantially shorter than said wings and cannot be bent by the longitudinal web tension when said wings are bent into said slots.

10. A method of reducing the likelihood of a crease-causing wave-like or ripple distortion developing across a donor web in a dye transfer printer when the donor web is subjected to a longitudinal tension as it is advanced from a print head, over a web guide bar that supports the donor web substantially widthwise and is compliant, and onto a web take-up spool, said method comprising:

effecting a curvature across the donor web in proportion to the longitudinal web tension in order to urge the donor web to spread substantially widthwise, by lengthwise bowing the compliant web guide bar due to the longitudinal web tension.

11. A dye transfer printer in which a dye donor web is capable of developing a crease-causing wave-like or ripple distortion across the donor web when the donor web is subjected to a longitudinal tension as it is advanced from a print head, over a web guide, and onto a web take-up spool, is characterized in that:

means for effecting a curvature across the donor web in proportion to the longitudinal web tension in order to urge the donor web to spread substantially widthwise to reduce the likelihood of the wave-like or ripple distortion developing across the donor web.

12. A method of improving a dye transfer printer in which a dye donor web is capable of developing a crease-causing wave-like or ripple distortion across the donor web when the donor web is subjected to a longitudinal tension as it is advanced from a print head, over a fixed web guide, and onto a web take-up spool, said method comprising:

removing the fixed web guide; and adding in place of the fixed web guide a longitudinal guide bar for supporting the donor web substantially widthwise that is compliant to be bowed lengthwise by the longitudinal web tension to effect a curvature across the donor web in proportion to the longitudinal web tension in order to urge the donor web to spread substantially widthwise to reduce the likelihood of the wave-like or ripple distortion developing across the donor web.

* * * * *